United States Patent [19]

Raulins et al.

[11] 4,086,935

[45] May 2, 1978

[54] REMOTE CONTROLLED TUBING SAFETY VALVE

[75] Inventors: George M. Raulins; Fleming A. Waters, both of Dallas, Tex.

[73] Assignee: Otis Engineering Corporation, Dallas, Tex.

[21] Appl. No.: 774,670

[22] Filed: Mar. 4, 1977

Related U.S. Application Data

[63] Continuation of Ser. No. 605,211, Aug. 15, 1975, abandoned.

[51] Int. Cl. ..... F16k 17/02

[52] U.S. Cl. ..... 137/522; 166/321; 251/63.6

[58] Field of Search ..... 137/495, 522, 629; 166/72, 224 A, 224 R, 321, 322, 324; 251/58, 62, 63.5, 63.6, 227, 315

[56] References Cited

U.S. PATENT DOCUMENTS

| | | | |
|---|---|---|---|
| 2,894,715 | 7/1959 | Bostock | 166/72 |
| 3,007,669 | 11/1961 | Freed | 251/315 |
| 3,035,808 | 5/1962 | Knox | 137/495 |
| 3,837,403 | 9/1974 | Mott | 251/62 |
| 3,860,066 | 1/1975 | Pearce et al. | 166/72 |
| 3,870,101 | 3/1975 | Helmus | 251/315 |

OTHER PUBLICATIONS

Composite Catalogue of Oil Field Equipment & Services, 1974–1975, pp. 3995, 3997, 3998, 4008, 4011 and 4014.

*Primary Examiner*—Martin P. Schwadron
*Assistant Examiner*—G. L. Walton
*Attorney, Agent, or Firm*—Vinson & Elkins

[57] ABSTRACT

A remote-controlled tubing safety valve having a check valve and a remotely controlled valve member operator movable between two positions. When the valve member operator is in a first position the check valve is maintained open. When the valve member operator is in a second position it does not interfere with the operation of the check valve. This abstract is neither intended to define the invention of the application which, of course, is measured by the claims, nor is it intended to be limiting as to the scope of the invention in any way.

12 Claims, 4 Drawing Figures

REMOTE CONTROLLED TUBING SAFETY VALVE

CROSS-REFERENCE TO RELATED APPLICATIONS

This application is a continuation of application Ser. No. 605,211 filed Aug. 15, 1975, now abandoned.

BACKGROUND OF THE INVENTION

A. Field of the Invention

This invention relates to remote-controlled tubing safety valves and more particularly to a tubing safety valve having a check valve and remote-control means for maintaining the check valve in open position.

B. The Prior Art

Remote-controlled tubing safety valves utilized in well installations are well known. Such valves are normally biased towards a closed position and are held open hydraulically. Although the valve is positioned in the tubing string, the hydraulic conduit controls are often at the surface. Having the controls at the surface permits the valve to be opened or closed regardless of the conditions at the valve. Such remote-controlled valves have the disadvantage that if it is desired to operate the valve in response to conditions at the valve, means must be provided for sensing these conditions at the surface and then means must be provided to operate in response to the sensed conditions. The remote sensing of conditions followed by the remote operation of the valve takes time. During this time period equipment and personnel at the surface may be damaged and/or injured. The remote sensing and controlled operation of the valve is simply not fast enough in all circumstances.

Sometimes remote-controlled tubing safety valves are opened without the use of the hyrdraulic control means. To open the valve, fluid is pumped downward into the tubing string until a sufficient pressure differential exists across the valve for the valve member to move to slightly open position. (See Composite Catalogue of Oil Field Equipment and Services 1974–75 pages 3997 and 3998 and U.S. Pat. No. 3,870,101 to Helmus). To partially open the valve by pumping through it, the force exerted by the main biasing means which urges the valve member closed and which is normally overcome by the hydraulic means, must be overcome by the pressure differential across the valve. When the valve member is opened in this manner it is only partially opened and a high velocity flow results. This high velocity flow can erode the valve member and the valve seat. If the valve becomes eroded it will leak and must be replaced. U.S. Re. Pat. No. 26,149 discloses a remote control subsurface tubing safety valve. One form of the valve has a flapper valve member. However, even this flapper valve can not be pumped through without overcoming the force of the main spring biasing the valve member to a closed position and thus cannot operate as a check valve responsive to conditions at the valve.

U.S. Pat. No. 3,860,066 to Pearce et al discloses a remote-controlled tubing safety valve having two springs. The springs acts against an operating sleeve to bias it to a first position where the valve member is in a valve closing position while hydraulic means move the operating sleeve to a second position so that the valve member is in a valve opening position. One spring is disposed above the valve member while the second spring is disposed below the valve member. In the first form of the valve the valve member is a rotating ball valve confined between two valve seats. To close the safety valve, the springs overcome the hydrostatic head of fluid in the hydraulic control conduit. Generally one heavy spring is provided to do this; however, as illustrated in the aforementioned patent to Pearce, two springs may be provided. The upper spring may be stronger than the lower so that it alone can move the valve member operator to valve closing position. The second spring operates in conjunction with the first spring to assist in moving the operator and to maintain the valve member tightly confined between its seats. The lower and upper springs may be of equal stength but is preferable to have the lower spring be weaker than the upper spring. This is because if the valve member is forced upward by the lower spring, the pivot of the valve member can become worn causing the valve to malfunction. Again if the valve disclosed in the aforementioned patent to Pearce was attempted to be opened by pumping through the valve rather than by utilizing the hydraulic control means, a high pressure differential would have to be created across the valve, high velocity flow through the valve would result thereby causing erosion of the valve member and valve seat surfaces.

There are valves having valve members that respond quickly to conditions at the location of the valve for movement between valve opening and closing positions. Such valves may be ambient-type (e.g. the valve closes when the ambient pressure around the valve drops below a predetermined level), a pressure-differential type (e.g. the valve automatically closes when there is an abnormal increase of pressure through the valve) or injection safety valves. (See Composite Catalogue of Oil Field Equipment & Services 1974–75 pages 3995, 4008 to 4011, and 4014). However, such valves only close in response to the predetermined condition and cannot be controlled to open or close from the surface.

Injection safety valves do respond quickly to close the tubing string whenever a backkick occurs. However, present injection safety valves have no means to maintain the valve in an open position if it is desired to have a high back flow rate through the valve because they are urged towards a close position by such back flow. In addition they may have biasing means to constantly urge the valve member to a closed position.

It is sometimes desirable to inject fluids in a well equiped with a subsurface safety valve. In doing so, it is desirable that a check valve be present down in the tubing to protect personnel and equipment at the well. Equipment has not been available for this purpose without running additional equipment in to the well.

OBJECTS OF THE INVENTION

It is an object of this invention to provide a remote-controlled subsurface tubing safety valve that may also be operated as a check valve which closes in response to flow conditions through the valve.

It is a further object of this invention to provide a check valve which may be remotely controlled to be maintained in an open position while reverse flow through the valve occurs or while no flow through the valve exists.

An additional object of this invention is to provide one valve assembly that may be operated either as a remote control tubing safety valve or as a check valve.

Another object is to provide equipment which will permit inject into a well through a subsurface check valve and which will operate as a subsurface safety valve when the well is flowing.

BRIEF DESCRIPTION OF THE DRAWINGS

In the drawing wherein like numerals indicate like part and wherein an illustrative embodiment is shown.

DESCRIPTION OF THE PREFERRED EMBODIMENT

Figure 1:
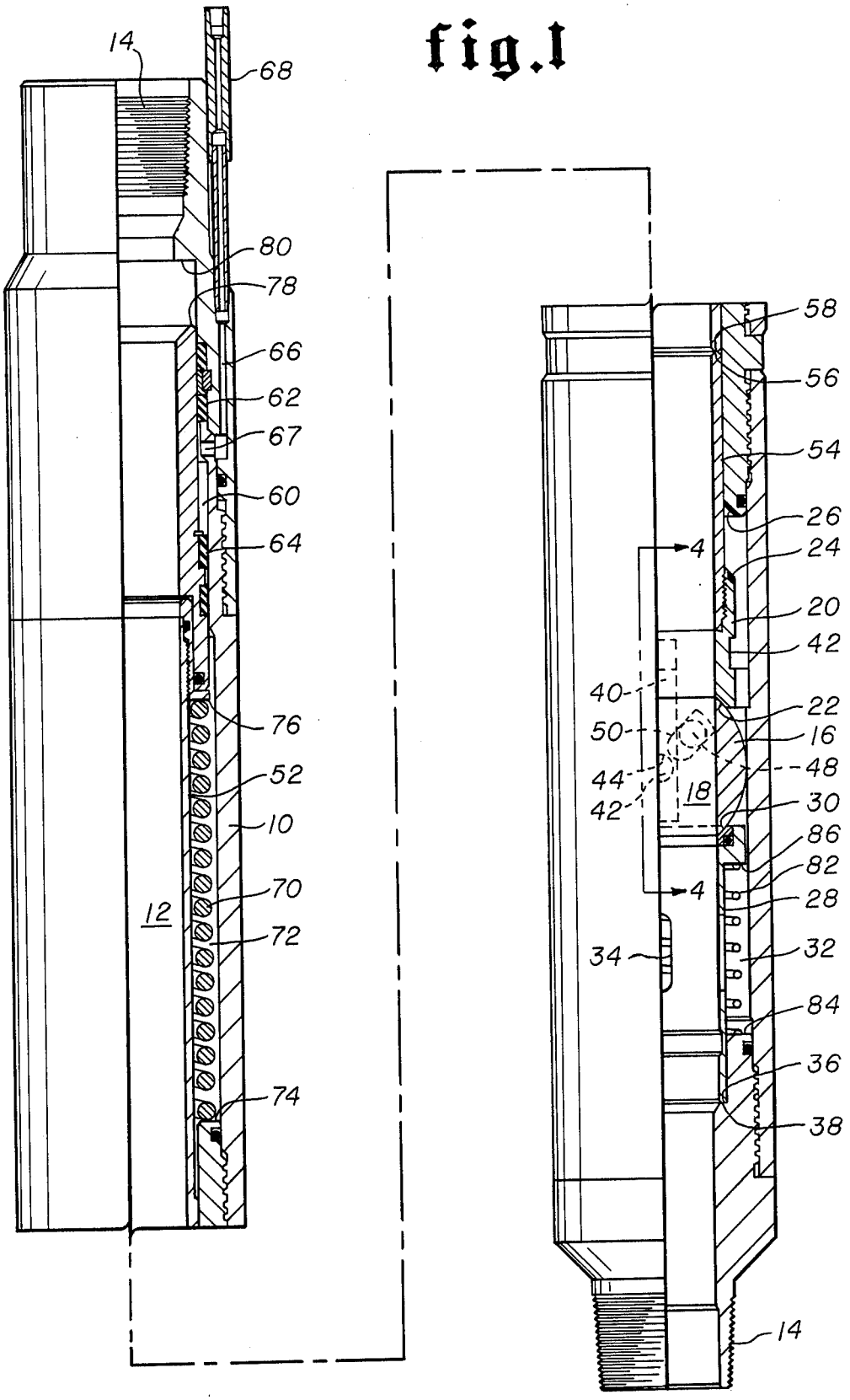
FIG. 1 is of the cross-sectional view of a tubing safety valve in a controlled open position.

The tubing safety valve of this invention is designed to conrol the flow of fluids through a tubing string of a well. For simplicity of illustration neither the well or tubing string is shown and only a valve is illustrated.

The tubing safety valve includes a housing, a check valve, and means for operating a check valve which permits both remote-controlled operation of the tubing safety valve and instantaneous check valve type operation of the tubing safety valve.

The housing 10 has a bore 12 therethrough. When the valve is opened, fluids pass through the bore 12. Means are provided for connecting the valve within the tubing string. The connecting means may be threads 14 at either end of the housing 10.

A check valve including a valve member and a valve seat is disposed in the bore 12 of the housing. The valve member is adapted for movement between bore opening and bore closing positions. Any desired type of check valve such as a ball or flapper may be used. The valve may be fluid closed or may be urged toward its seat in any desired manner.

The illustrated check valve includes a rotating ball valve member 16. The valve member 16 has a passage 18 therethrough of substantially the same diameter as the bore 12. The vale member 16 is rotable between the position shown in FIGS. 1 and 3, where the passage 18 is aligned with the bore 12 and fluid can flow through the valve, and the position shown in FIG. 2 where the passage 18 is not aligned with the bore 12 and an effective seal to upward fluid flow through the valve is provided.

An upper seat member 20 seals with the valve member 16 and the housing 10 to inhibit upward fluid flow through the safety valve when the valve member 16 is in a bore closing position. To seal with the valve member 16 the upper seat member 20 has sealing face 22, while to seal with the housing the upper seat member has a sealing face 24 which contacts a sealing surface 26 of the housing. Engagement of the sealing face 24 with the sealing surface 26 also limits the upward movement of the upper seat member 20 and the ball valve member 16.

The check valve assembly also includes a lower valve seat member 28. This seat member 28 also has a sealing face 30 which engages the ball valve member 16. To prevent a pressure build up in the annulus 32 between the lower seat member and the housing 10 which could inhibit the downward movement of the lower seat member, and thus of the ball valve member 16, a port 34 is located in the wall of the lower seat member 28. The downward movement of the ball valve member 16 is stopped with the valve member in a valve opening position by the engagement of the edge 36 of the lower seat member with a shoulder 38 of the housing 10.

Preferably, the rotating ball valve member 16 is confined between the upper seat member 20 and the lower seat member 28 in such a manner that the sealing faces 22 and 30 remain in contact with the outer surface of the ball valve member 16. This confinement wipes the ball valve member 16 clean whenever it is rotated and prevents a build up of material around the seats which may inhibit the sealing.

To maintain the ball valve member 16 in contact with the sealing face 22 of the upper seat member 20 and to also provide an axis about which the ball valve member 16 may rotate, fingers 40 are hung from an annular recess 42 around the upper seat member 20. (See FIG. 4) One finger 40 is disposed on each side of the ball valve member 16. Each finger 40 has a pin 42 projecting into a circular recess 44 formed on the side of the ball valve member. To turn the ball valve member 16 as it moves longitudinally within the housing 10, a pin 48 (shown in dashed lines) on the interior of the housing is provided which projects into a recess 50 (shown also in dashed lines) of the ball valve member 16. Longitudinal movement of the ball valve member 16 with respect to the pin 48 results in the ball valve member 16 rotating about pin 42 between the valve opening position shown in FIGS. 1 and 3 and the valve closing position shown in FIG. 2.

Figure 2:
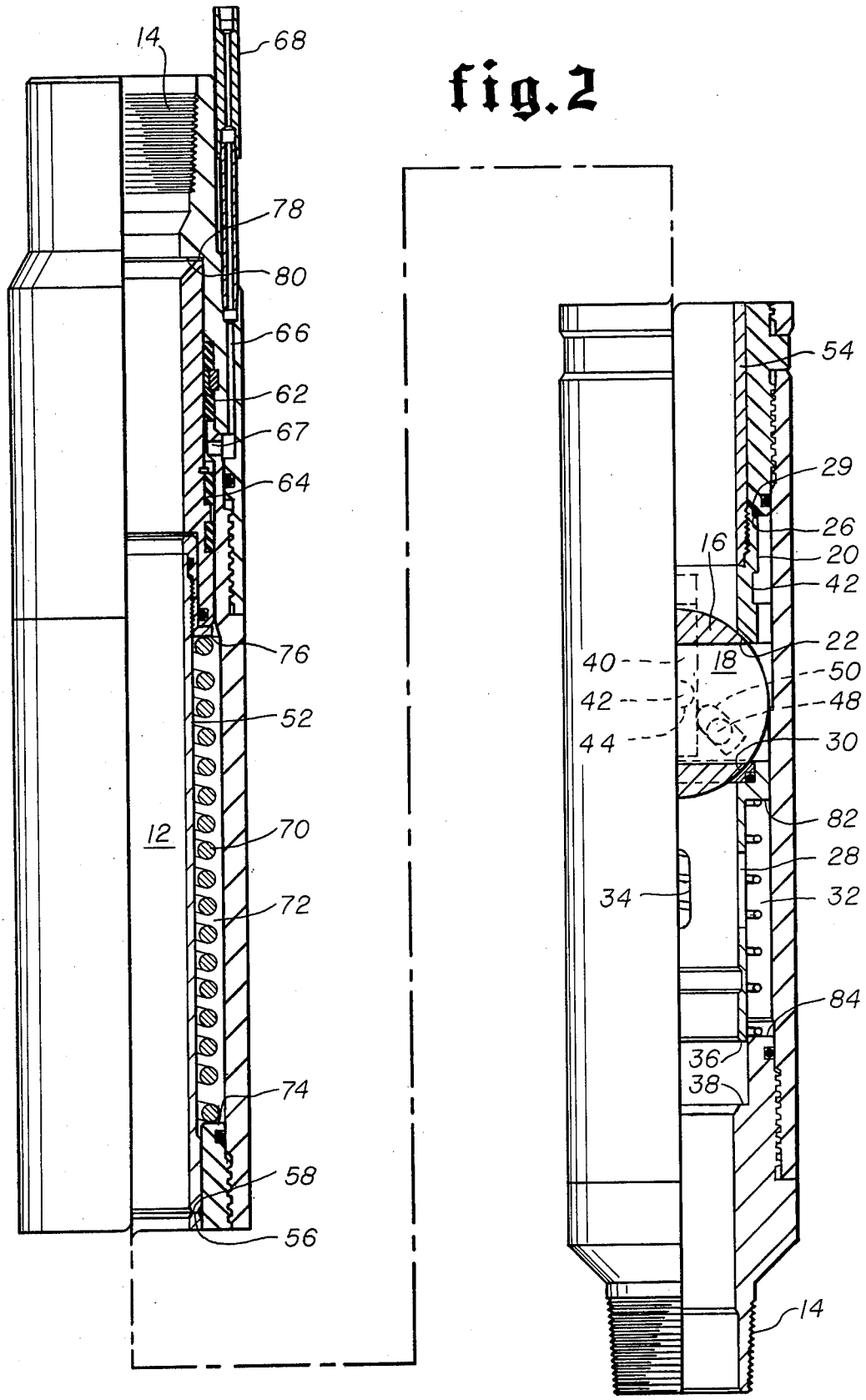
FIG. 2 is a cross-sectional view of the tubing safety valve in a closed position.

A valve member operator provides a portion of the means by which the valve member is remotely controlled. The valve member operator is movable to a first position, as shown in FIG. 1, wherein the valve member 16 is in a valve opening position and is also movable to a second position, as shown in FIG. 2, wherein the valve member 16 in a valve closing position. When the valve member operator is in its second position it is in an out-of-way position and does not interfere with the operation of the valve member so that the valve member may function as a check valve independently of the valve member operator.

Figure 3:
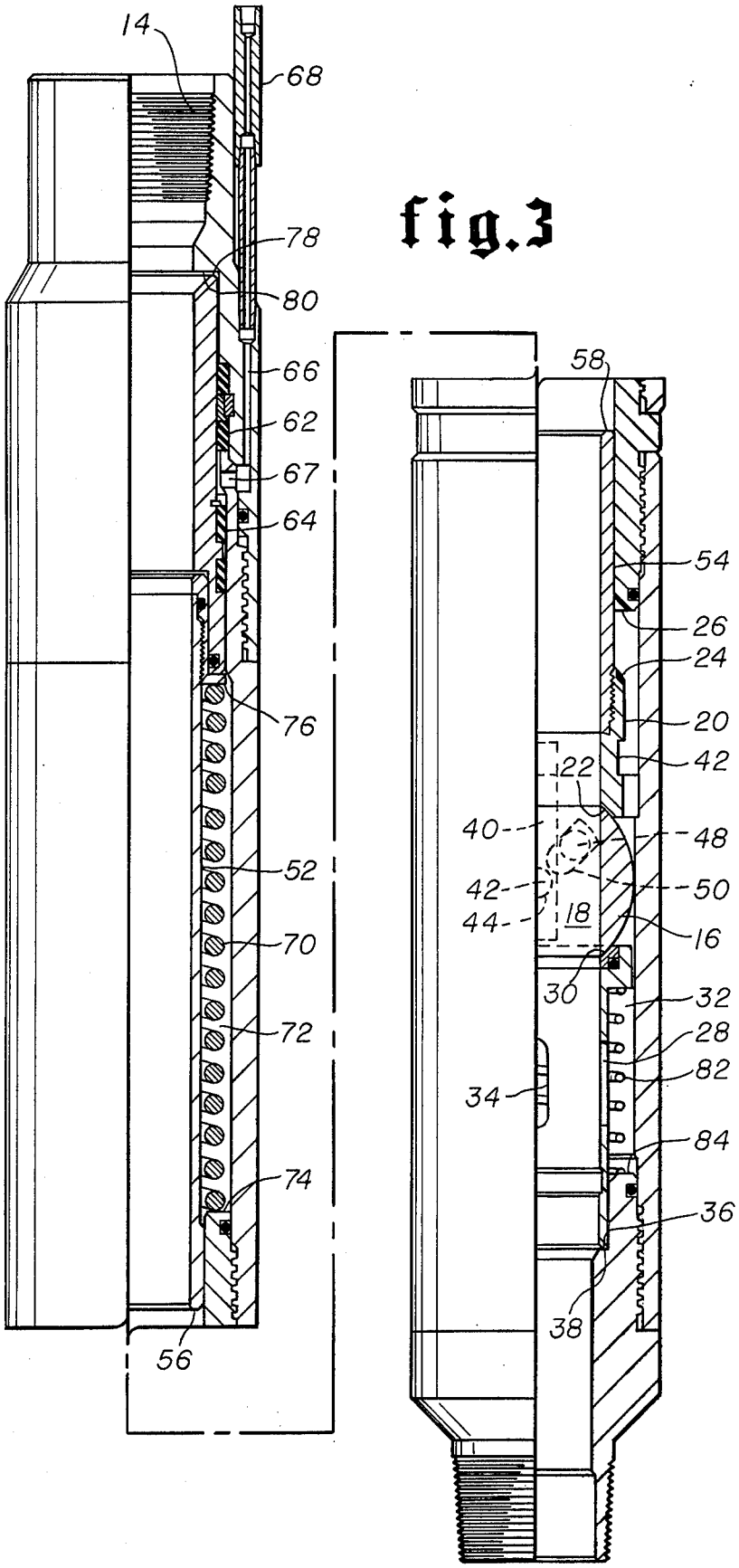
FIG. 3 is another cross-sectional view of the tubing safety valve in the open position when used as a check valve.
Figure 4:
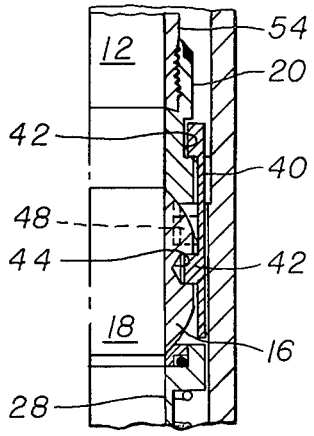
FIG. 4 is a cross-sectional view taken along line 4-4 of FIG. 1 showing the means for mounting the valve member in the valve.

As illustrated the valve member operator may be a two piece valve member operator. One sleeve 52 forms one piece while a second sleeve 54 forms a second piece. The bottom edge 56 of the one sleeve 52 abuts the top edge 58 of the second sleeve 54 when the valve member operator is moved to its first position. (See FIG. 1) The one piece 52 is also movable to a second out-of-the-way position as shown in FIGS. 2 and 3. When the one piece 52 of the valve member operator is in its second position, it permits movement of the second piece 54 of the valve member operator between the first position wherein the valve member is in a bore opening position (as shown in FIG. 3) and a second position wherein the valve member is in a bore closing position (as shown in FIG. 2).

A pressure responsive means controls the movement of the valve member operator to its first position to move the valve member to a bore opening position. The illustrated pressure responsive means is associated with said one sleeve 52 of the valve member operator and includes a pressure chamber 60 in the annulus between said one piece of said valve member operator 52 and the housing 10. Fixed seal 62 on the housing and sliding seal 64 on said one piece 52 of the valve member operator permit the valve member operator to slide longitudinally with respect to the housing 10 whenever the chamber 60 is pressurized.

Means for conducting fluid to the pressure responsive is provided to permit remote controlling of the valve member operator. The fluid conducting means includes a passageway 66 through the housing 10 opening into the chamber 60 at port 67. To the housing 10 is connected a conduit 68 in communication with the passageway 66. The conduit 68 extends to any desired location, normally a surface located control unit. Alternatively, instead of having a conduit 68 fluid pressure in the annulus around the housing 10 may be utilized to pressurize the fluid responsive means.

First biasing means move the valve member operator to its second out-of-the-way position upon a decrease of fluid pressure in the conducting means to a selected pressure. The first biasing means exerts a force against the valve member operator sufficient to overcome the force exerted against the valve member operator by the hydrastatic head of fluid that remains in the conducting means when the pressure is relieved in the conducting means.

The illustrated first biasing means is provided by a main spring 70 disposed in the annular chamber 72 between the one sleeve 52 of the valve member operator and the housing 10. This spring 70 is engaged by a shoulder 74 of the housing, and it engages a shoulder 76 of the sleeve 52. The spring 70 moves the one piece 52 of the valve member operator to a second position upon a decrease of fluid pressure in the conducting means to a selected pressure.

Stop means are provided to limit the movement of the valve member operator once it has reached its second position under the action of the first biasing means. This stop means comprises the upper edge 8 of the one sleeve 52 of the valve member operator and a downward facing shoulder 80 in the housing which abut when the sleeve 52 is in its second posittion as shown in FIGS. 2 and 3.

The check valve also includes means for urging the valve member to a bore closing position onto its valve seat. However, the urging means permits the valve member to be moved to a bore opening position both by movement of the valve member operator to a first position and by pumping fluid through the tubing in a first, downward, direction. The movement of the valve member to a bore opening position by pumped fluid is accomplished without requiring that the force of the main spring 70 be overcome by having the urging means operate independently from the first biasing means 70.

In the embodiment shown, the urging means is provided by backwell pressure and a second biasing means. When the one sleeve 52 of the valve member operator is in its first upper position (FIGS. 2 and 3), fluid flow in a second, upward, direction through the tubing string will act against the valve member 16 to move it to the bore closing position. (FIG. 2) Assisting the backwell pressure is a second biasing means. The second biasing means includes a follower spring 82 disposed in the annular space 32 between the lower seat member 28 and the housing 10. This spring bears against a shoulder 84 of the housing and a shoulder 86 of the lower seat member 28 to bias the lower seat member 28 and thus the ball valve member 16 to bore closing position. Since the follower spring 82 does not have to assist the main spring 70 in overcoming the hydrostatic head of fluid in the conduit 68, and since its function is simply to bias the valve member 16 to a closed position, it can be much weaker than the main spring 70 so that fluid being pumped in a downward direction through the tubing will overcome the force exerted on the valve member 16 by this spring 82 and move the valve member 16 to its bore opening position. (FIG. 3).

In operation the disclosed valve member may be operated both as a remote-controlled tubing safety valve and as an injection valve.

As a remote controlled tubing safety valve the valve is opened in the conventional manner. Fluid is transmitted through the conducting means to the pressure responsive means. When the pressurized fluid in the chamber 60 overcomes the force exerted upon the one sleeve 52 of the valve member operator by the main spring 70, the pressure responsive means moves the valve member operator to a first position (See FIG. 1) thereby moving the valve member 16 to its bore opening position. The valve is maintained in the opened position as long as the pressure in the conducting means is maintained. To close the safety valve the pressure in the conducting means is relieved. The main spring 70 then exerts a force against the one piece 52 of the valve member operator greater than that exerted upon it by the pressure responsive means due to the hydrostatic head of fluid in the conducting means thereby moving said one piece 52 of the valve member operator to a second position. (FIG. 2) With the one piece 52 of the valve member operator in this second out-of-the-way position, the valve member 16 is movable between positions opening and closing the bore 12. The urging means 82 is relied upon to move the valve member 16 to a bore closing position.

To operate the safety valve as an injection safety valve the conducting means is depressurized. The main spring 70 holds the one piece 52 of the valve member operator in its second out of the way position. (Illustrated in FIGS. 2 and 3). To move the valve member 16 to a bore opening position, fluid is pumped into the tubing in a first, downward, direction. The fluid acts against the valve member 16 and moves it against the force of the urging means to a bore opening position. (FIG. 3) Since the means for urging the valve member 16 to a bore closing position is substantially weaker than the main spring 70, a small pressure differential across the valve member 16 will move the valve member to a substantially full bore opening position without causing a high velocity flow through the valve.

As an injection safety valve, the valve member will move to a bore closing position in response to flow conditions at the valve. In the event of a back pressure kick through the valve, the valve member 16 will be forced to the bore closing position illustrated in FIG. 3. Under such conditions, the second biasing means 82 supplements the closing force exerted on the valve member by the reverse fluid flow. However, in the event that fluid flow in a downward direction through the valve ceases and there is no reverse flow, the second biasing means 82 will again move the valve member 16 to a bore closing position.

Thus it can be seen that what has been provided is a remote controlled tubing safety valve comprising a check valve and means, including a valve member operator, for overcoming the means which urges the check valve member onto its valve seat. When the valve member operator is in its first position it maintains the valve member in a valve opening position. When the valve member operator is in a second position it does not interfere with the operation of the check valve. The valve member operator is remotely controlled by pressure responsive means, which moves the valve member operator to its first position; fluid conducting means, to actuate the pressure responsive means; and first biasing means, to move the valve member operator to its second position upon a decrease of fluid pressure in the conducting means.

With the valve member operator being formed in two pieces with the one piece 52 being movable between first and second positions in response to the pressure responsive means and the first biasing means and with the valve member being associated with the second piece, the valve member is movable between bore opening and bore closing positions when the one piece of the valve member operator is its second position. When the valve member operator is in this position the valve member and the urging means function as a check valve so that the valve member is moved to a bore opening position by fluid flowing through the valve in one direction, but is immediately moved to a bore closing position in the event of a back kick, reverse fluid flow or a stoppage of fluid flow in said one direction to protect men and equipment on the surface. Thus fluid may safely be injected in to the well without installing additional equipment.

Although a rotating ball valve member has been illustrated it is to be understood that any type of valve member may be utilized.

From the foregoing it can be seen that the objects of this invention have been met. Utilization of the pressure responsive means permits the safety valve to be operated as a remote-controlled tubing safety valve. However, with the pressure relived the safety valve operates as an injection safety valve. One safety valve assembly can thus be selectively operated in response to remote controls or a response to flow conditions at the valve.

The foregoing disclosure and description of the invention are illustrative and explanatory thereof and various changes in the size, shape and materials, as well as in the details of the illustrated construction may be made within the scope of the appended claims without departing from the spirit of the invention.

What is claimed is:

1. A remote controlled tubing safety valve comprising:

a housing having a longitudinal bore for providing a fluid flow path, extending therethrough;

a check valve including a valve member and a valve seat disposed in the bore of said housing and means for urging said valve member to a bore closing position onto said valve seat;

valve member operator means, including at least two sleeve means disposed in said longitudinal bore and with each of said two sleeve means being axially movable therein between a first and second position and having a passage extending longitudinally therethrough through which fluids may flow;

one of said two sleeve means defining an annulus between said housing and said one sleeve means;

the other of said two sleeve means controlling movement of said valve member;

said one sleeve means when in its first position maintaining said other sleeve means in its first position with said other sleeve means in turn maintaining said valve member in a bore opening position and when in said second position not interfering with the movement of said other sleeve means;

pressure responsive means, including a pressure chamber formed in said annulus, for moving said one sleeve means to said first position when said means is acted upon by pressurized fluid; and biasing means for moving said one sleeve means to said second position upon a decrease of fluid pressure acting upon said pressure responsive means to a selected value;

said valve member being normally moved to a bore closing position by said means for urging and being movable towards a bore opening position by fluid being pumped through said longitudinal bore in a first direction without affecting said biasing means when said one sleeve means is in said second position.

2. A remote controlled tubing safety valve comprising:

a housing having a longitudinal bore, for providing a fluid flow path, extending therethrough;

a valve member in the bore of said housing adapted for movement between a full bore opening position and a bore closing position;

a valve member operator, including at least two sleeve means disposed in said longitudinal bore and with each of said sleeve means being axially movable therein between a first and second position and having a passage extending longitudinally therethrough through which fluids may flow;

one of said two sleeve means defining an annulus between said housing and said one sleeve means;

the other of said two sleeve means controlling movement of said valve member;

said one sleeve means maintaining said other sleeve means in its first position with said other sleeve means in turn maintaining said valve member in a full bore opening position when in its first position and not interfering with the movement of said other sleeve means when in said second position;

pressure responsive means, including a pressure chamber formed in said annulus, for controlling movement of said one sleeve means by moving said one sleeve means to said first position when acted upon by fluid pressurized above a selected value;

first biasing means for moving said one sleeve means to a second position upon decrease of pressure acting upon said pressure responsive means to a selected value;

means for urging said other sleeve means towards its second position to move said valve member to a bore closing position;

said valve member, when said one sleeve means is in said second position, being movable towards a bore opening position by fluid being pumped through said bore in a first direction without affecting said first biasing means and without said first biasing means resisting such movement and normally assuming a bore closing position upon a cessation of fluid flow in said first direction under the effect of said urging means.

3. The valve of claim 2 wherein said urging means includes: second biasing means which exerts substantially less force to move said valve member to a bore closing position than said first biasing means exerts to move said valve member operator to said second position.

4. A remote controlled tubing safety valve comprising:

a housing having a longitudinal bore, for providing a fluid flow path, extending therethrough;

a valve member disposed in the bore of said housing and adapted for movement between a full bore opening position and a bore closing position;

a valve member operator, including at least two sleeve means disposed in said longitudinal bore and with each of said two sleeve means being axially movable therein between a first and second position and having a passage extending longitudinally therethrough through which fluids may flow;

one of said two sleeve means defining an annulus between said housing and said one sleeve means;

the other of said two sleeve means controlling movement of said valve member;

said one sleeve means maintaining said other sleeve means in its first position with said other sleeve means in turn maintaining said valve member in a full bore opening position when in its first position and being movable to a second, out-of-the-way position which second position permits said second sleeve means to move between its first and second position to permit said valve member to move between said positions opening and closing the bore;

pressure responsive means, including a pressure chamber formed in said annulus, for controlling movement of said one sleeve means by moving said one sleeve means to said first position when acted upon by pressurized fluid;

first biasing means for moving said one sleeve means to said second positon upon a decrease of pressure acting upon said pressure responsive means to a selected value;

urging means for urging said other sleeve means to its second position to move said valve member to a bore closing position, said urging means being operable independently from said first biasing means so that when said one sleeve means has been moved to said second position by said first biasing means said valve member is normally moved to a bore closing position by said urging means and may be moved towards a bore opening position by the force of fluid being circulated through the housing in one direction acting to overcome said urging means without acting to overcome said first biasing means and without said first biasing means resisting such movement, said urging means moving said valve member to its bore closing position upon a cessation of fluid circulation in said one direction through the housing.

5. The valve of claim 4 wherein said urging means includes:

second biasing means which exerts substantially less force to move said valve member to a bore closing position than the first biasing means exerts to move said valve member operator to said second position.

6. A remote controlled tubing safety valve comprising:

a housing having a longitudinal bore, for providing a fluid flow path, extending therethrough;

a valve member disposed in the bore of said housing and movable between a bore closing position and a full bore opening position;

a two piece valve member operator, comprising two aligned sleeves, each of which is disposed in said longitudinal bore and each of which is axially movable therein between first and second positions;

one piece of said valve member operator, together with said housing, defining an annulus therebetween, and when in its first position holding the second piece of said valve member in its first position which second piece in turn holds said valve member in a full bore opening position;

pressure responsive means, including a pressure chamber formed in said annulus and a seal carried by one piece of said valve member operator;

said pressure responsive means moving both pieces of said valve member operator to their first position upon said pressure responsive means being subjected to a pressure greater than a selected pressure;

first biasing means to move said one piece of said valve member operator to its second position upon decrease of pressure to said pressure responsive means to a selected pressure;

said second piece of said valve member operator, when said one piece is in its second position, being movable between its first position holding said valve member in a bore opening position and its second position in which said valve member is in a bore closing position; and means for urging said valve member to a bore closing position, which means normally moves said valve member to a bore closing position with said second piece of said valve member operator in its second position when said one piece of said valve member operator is in its second position and which means may be overcome by fluid being circulated through the bore in a first direction to move said valve member towards its bore opening position and said second piece towards its first position without moving said first piece from its second position and without affecting said first biasing means and without said first biasing means resisting such movement, and said urging means moving said valve member to its bore closing position upon a cessation of fluid circulation in said first direction through the bore.

7. The valve of claim 6 wherein:

said two aligned sleeves have their adjacent ends in abutment when the valve member operator is in a first position due to pressurized fluid greater than a selected pressure being effective upon said pressure responsive means and with the adjacent ends of said sleeves being spaced when said one piece of said valve member operator is in said second position while said second piece of said valve member operator is in its first position.

8. The valve of claim 6 wherein said urging means includes second biasing means, and said second biasing means exerting substantially less force upon said valve member than said first biasing means exerts upon said first piece of said valve member operator.

9. A remote controlled tubing safety valve comprising:

a housing having a longitudinal bore, for providing a fluid flow path, extending therethrough;

a rotating ball valve member disposed in the bore of said housing and having a passage therethrough, said ball valve member being rotatable between a bore closing position with said passage not aligned with said bore and a full bore opening position with said passage aligned with said bore;

a two piece valve member operator comprising two aligned sleeves disposed in said longitudinal bore, one piece of said two piece valve member operator comprising one of said two aligned sleeves, the other piece of said two piece valve member operator comprising the other of said two aligned sleeves, said one sleeve and said housing defining an annulus therebetween, and said two aligned sleeves having a passage extending therethrough through which fluids may flow;

pressure responsive means associated with said one piece of said valve member operator and including a pressure chamber formed in said annulus;

said pressure responsive means moving said one piece of said valve member operator to a first position upon conduction of pressurized fluid to said pressure responsive means;

said one piece of said valve member operator moving the second piece of said valve member operator to a first position while it is being moved to a first position by the pressure responsive means;

said valve member operator rotating said ball valve member to a full bore opening position while said second piece is being moved to said first position;

first biasing means to move said one piece of said valve member operator to a second position upon decrease of pressure to said pressure responsive means to a selected value;

said second piece of said valve member operator, when said one piece is in its second position, being movable between a first position in which said ball valve member is in a bore opening position and a second position in which said ball valve member is in a bore closing position; and means for urging said ball valve member to a bore closing position including second biasing means, which means normally moves said ball valve member to a bore closing position, with said second piece of said valve member operator in its second position, when said one piece of said valve member operator is in its second position and which means may be overcome by fluid being circulated through the bore in a first direction to move said ball valve member towards its bore opening position and said second piece towards its first position without moving said one piece from its second position and without affecting said first biasing means and without said first biasing means resisting such movement, and said urging means moving said valve member to its bore closing position upon a cessation of fluid circulation in said first direction through the bore.

10. The valve of claim 9 wherein said second biasing means exerts substantially less force upon said ball valve member than said first biasing means exerts upon said first piece of said valve member operator.

11. The valve of claim 9 wherein:

said two aligned sleeves have their adjacent ends in abutment when the valve member operator is in a first position due to pressurized fluid greater than a selected pressure being effective upon said pressure responsive means and with the adjacent ends of said sleeves being spaced when said one piece of said valve member operator is in said second position while said second piece of said valve member operator is in its first position.

12. A remote controlled tubing safety valve comprising:

a housing having a longitudinal bore, for providing a fluid flow path, extending therethrough;

a check valve including a valve member and a valve seat disposed in the bore of said housing and also including means for urging said valve member to a bore closing position onto said valve seat and with said valve member being movable to a full bore opening position;

two piece valve member operator means for controlling movement of said valve member, both pieces being disposed in said longitudinal bore, being axially movable therein between a first and a second position and having a passage extending therethrough through which fluids may flow;

one piece of said two piece valve member operator means, together with said housing defining an annulus therebetween;

pressure responsive means, including a pressure chamber formed in said annulus and a seal carried by said one piece of said two piece valve member operator means, for moving said one piece to said first position when said pressure responsive means is acted upon by pressurized fluid;

said one piece of said two piece valve member operator means when in its first position holding the second piece of said valve member operator means in its first position which second piece in turn holds said valve member in a full bore opening position;

said one piece of said two piece valve member operator means when in its second position not interfering with the operation of said check valve;

said valve member normally assuming a bore closing position under the effect of said means for urging and being movable towards a bore opening position by fluid being pumped through said bore in a first direction when said one piece of said two piece valve member operator means is in said second position without effecting said first biasing means and without said first biasing means resisting such movement, and said valve member returning to its bore closing position under the effect of said urging means upon a cessation of fluid flow through said bore in said first direction.

* * * * *